United States Patent [19]

Rezewski et al.

[11] 4,415,026

[45] Nov. 15, 1983

[54] ROLLER GUIDE FOR OIL-WELL PUMP

[76] Inventors: Joe Rezewski, Box 1199; Wayne Bernes, Box 1387, both of Drayton Valley, Alberta, Canada

[21] Appl. No.: 227,316

[22] Filed: Jan. 22, 1981

[30] Foreign Application Priority Data

Jan. 23, 1980 [CA] Canada ..... 344271

[51] Int. Cl.[3] ..... E21B 33/03

[52] U.S. Cl. ..... 166/97; 166/84

[58] Field of Search ..... 166/84, 97, 77, 77.5; 175/220; 308/49; 464/165, 166, 167, 168

[56] References Cited

U.S. PATENT DOCUMENTS

| | | | |
|---|---|---|---|
| 1,144,098 | 6/1915 | Black | 464/165 |
| 1,655,159 | 3/1928 | Parrish | 166/84 |
| 1,782,851 | 11/1930 | Hoffman et al. | 166/84 X |
| 1,898,311 | 2/1933 | Pettitt | 166/84 X |
| 2,169,264 | 8/1939 | Long | 464/165 |
| 2,466,239 | 4/1949 | Holcombe | 166/84 X |
| 4,099,562 | 7/1978 | Mattoon | 166/84 |

*Primary Examiner*—Ernest R. Purser
*Assistant Examiner*—Michael J. Starinsky
*Attorney, Agent, or Firm*—Lawrence I. Field

[57] ABSTRACT

A guide for guiding a pump-rod in a well-head consisting of a housing capable of being held between a well-head tee and a stuffing box comprising an enclosure having two pairs of transversely rotatable rollers positioned substantially at right angles to each other, each roller of each pair being offset from the center line of the pump-rod such that the pump-rod will pass between both sets of rollers so that it will be guided during operation in a reciprocating path.

5 Claims, 7 Drawing Figures

ROLLER GUIDE FOR OIL-WELL PUMP

This invention relates to a roller guide for an oil-well pump for minimizing wear which normally occurs in an oil-well stuffing box.

In oil retrieval from deep wells, it is normal to pump the oil from the ground by utilizing a reciprocating pump which is driven by mechanism on the surface through a pump-rod (Polish rod) which extends from the operating mechanism down into the well through a pipe casing. The oil is lifted up through the casing by the reciprocating pump to be pumped to a storage facility before being further processed, and a stuffing box or packing gland is used between the upper end of the casing and the pump-rod to prevent escape of oil. The operating mechanism used for reciprocating the pump-rod is of the well-known beam type which does not provide a pure reciprocating movement to the pump-rod. Also the pump-rod is not restrained in the casing so that it moves in a purely reciprocating manner. During operation of the pump, there is therefore a transverse movement of the pump-rod during its reciprocation, which under normal circumstances very quickly wears the packing in the stuffing box. As leakage of oil through the stuffing box cannot be tolerated, there is therefore, during normal pump operation, a requirement to replace the packing in the stuffing box at frequent intervals which is both time consuming and expensive.

This invention is concerned with the provision of a guide for the pump-rod which will force the pump-rod to move in a reciprocating manner at a region adjacent to the stuffing box so that the pump-rod will move only in a reciprocating manner through the stuffing box and hence reduce wear of the packing in the stuffing box so that frequent replacement of the packing in the stuffing box is not required. The guide of this invention is also made so that it can be inserted into a normal well-head apparatus without the need for any modifications having to be made to the well-head apparatus. The guide is therefore capable of being used to solve a problem in the pumping of oil which has occurred since the development of oil fields.

The guide of this invention consists in general of a housing which includes two sets of parallel rollers mounted upon axes which are at right angles to each other, each roller of a pair being spaced apart such that a pump-rod can be guided between the rollers without any transverse movement of the pump-rod occurring through the guide.

A second embodiment of this invention also includes a flap-valve which is situated inside the housing and above the two sets of parallel rollers, so that if the pump-rod breaks and leaves the stuffing box, the flap-valve will swing upwardly and close off the opening through the stuffing box so preventing escape of oil.

The invention will now be described with reference to the accompanying drawings in which.

Figure 1:
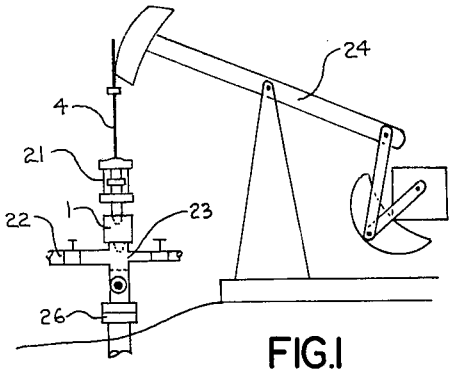
FIG. 1 is a general view of a normal type of well-head and pumping unit in which the guide of this invention has been inserted.
Figure 3:
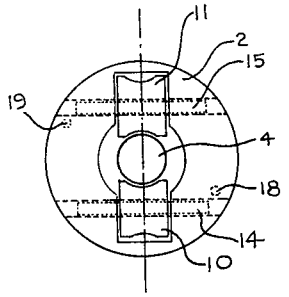
FIG. 3 is a top view of the upper roller system of FIG. 2.
Figure 5:
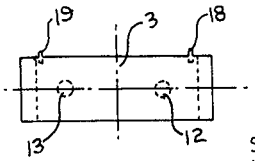
FIG. 5 is a side view of the roller set of FIG. 4.
Figure 4:
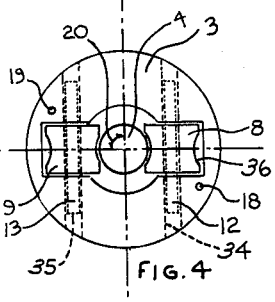
FIG. 4 is a top view of the lower roller set of FIG. 2.
Figure 2:
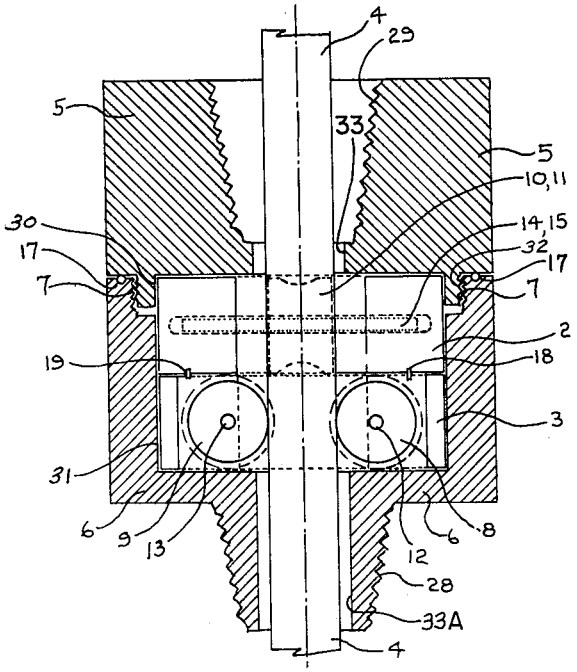
FIG. 2 is a partly cross-sectional view of the guide of this invention.

Referring to the drawings, in FIG. 1, there is shown a pumping unit 24 which drives, in a reciprocating manner, a pump-rod 4 through a stuffing box 21 into a casing 26. The oil is pumped up the casing 26 to a tee 23 and along pipe 22 to a storage facility. All of the above structure is conventional and need not be further detailed. The guide of this invention is designated by numeral 1 and is inserted between the stuffing box 21 and the tee 23.

Referring to FIGS. 2 through 5, the guide 1 consists of an upper housing 5 and a lower housing 6. The upper housing has internal tapered threads 29 which are sized to fit the lower conventional threads of stuffing box 21; a shallow cylindrical bore 30; an outer threaded flanged portion 32 and a smaller diameter bore 33. The lower housing 6 has an outer threaded portion 28; a cylindrical bore 31; and a smaller diameter bore 33A which is coaxial with bore 33 in the upper housing 5.

The upper and lower housings 5 and 6 can be threaded together by cooperating threads 7 and 32 to form a combined housing having an upper inner threaded portion 29, a lower outer threaded portion 28, and a cylindrical enclosure formed from bores 31 and 32 in the housing. This combined housing can be secured into position between the stuffing box 21 and the upper end of the tee 23. Inside the enclosure in the combined housing, there are fitted two sets of roller units. The lower roller unit which is detailed in FIGS. 4 and 5, consists of a machined cage 3 which is a sliding fit in bore 31, the cage 3 have two transverse bores 34 and 35 in which shafts 12 and 13 respectively are accommodated. Upon each shaft, there are rotatably mounted rollers 8 and 9 respectively which are each formed in a cylindrical shape having an outer concave groove 36 which is formed on a circle of substantially the same diameter as the pump-rod 4. A substantially indentical type of roller unit is installed above the above-described roller unit, this second roller unit having a cage 2, pins 14 and 15 and rollers 10 and 11 upon the pins. Both of the roller units are positioned inside the enclosure within the combined housing, and are held in a position such that each pair of rollers is at 90° to the other pair. Both roller cages are held in respective position by dowen pins 18 and 19 which are inserted between the mating faces of roller cages 2 and 3. An O-ring 17 is also assembled in a groove in housing 6 resulting in a positive seal between housings 5 and 6.

The pump-rod 4 is therefore, when operating, guided along a purely reciprocating path through guide 1 between the rollers 8, 9, 10 and 11, and as such operates on a reciprocating path through the stuffing box 21, there is thus a minimum amount of wear caused by the pump-rod 4 reciprocating through the stuffing box 21 and the packing in the stuffing box 21 is capable of lasting for a relatively long length of time as compared to the length of service of packing in stuffing boxes presently in use.

Figure 7:
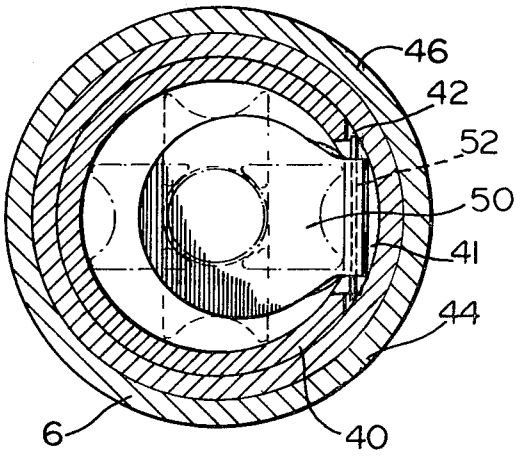
FIG. 7 shows the flap value assembly.
Figure 6:
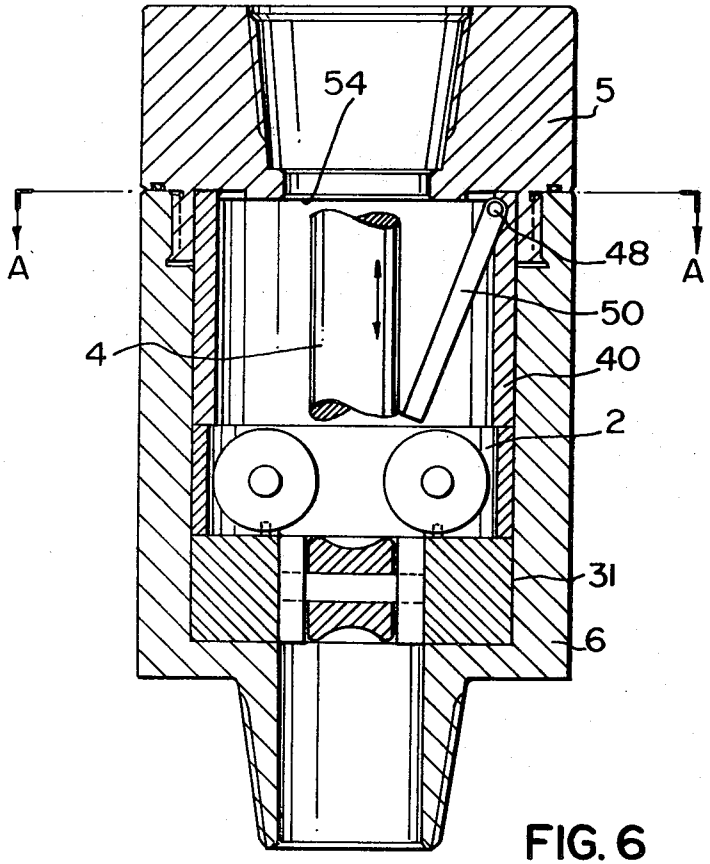
FIG. 6 is another embodiment of the invention.

The embodiment shown in FIGS. 6 and 7 has a body 6 which is longer than that shown in FIGS. 1 through 5, and a sleeve 40 is fitted within cylindrical bore 31 between upper cage 2 and the upper housing 5.

The sleeve 40 has bosses 41 and 42 formed at its upper end, and bores 44 and 46 therethrough which accommodate a pin 48. A flap-valve 50, having a bore 52 through its upper end, is hung from pin 48.

When the pump is functioning normally, the flap-valve 50 is hanging downwardly as shown in FIG. 6, with the pump-rod 4, only part of which is shown, being guided through the roller guides. If however, the pump-rod 4 breaks in the region of the roller guides, the rod 4 is withdrawn upwardly out of the well-head and the lower part of the rod 4 falls downwardly into the well. Leakage of oil would then normally occur, however, with this invention as soon as oil begins to flow upwardly through the well-head, the flap-valve 50 moves upwardly under the influence of the oil flow and closes off aperture 54. A coil spring could be fitted between the sleeve 40 and the flap-valve 50 to assist in moving valve 50 upwardly, however under normal conditions, this will not be required.

Of course, if the pump-rod 4 breaks and remains within the guide rollers and through the stuffing box, there cannot be any oil leakage and the flap-valve 50 will not operate.

The embodiments of the invention in which an exclusive property or privilege is claimed are defined as follows:

1. A guide for guiding a pump-rod in a well-head consisting of:

a housing capable of being held between a wellhead tee and a stuffing box comprising an enclosure having two pairs of transversely rotatable rollers positioned substantially at right angles to each other, each pair of transverse rollers being held in a separate cage, each having a pair of parallel pins upon which the rollers are rotatably mounted and one cage being located above the other and being located relative to the other by a dowel between the mating faces of the cages, each roller of each pair being off-set from the center line of the pump-rod such that the pump-rod will pass between both sets of rollers to be guided, during operation, in a reciprocating path.

2. The guide of claim 1, wherei the housing is comprised of an upper housing and a lower housing which are secured to each other by a screw threaded joint adjacent to the peripheries of the upper and lower housings.

3. The guide of claim 1 or 2 wherein the housing has a cylindrical enclosures therein and each cage is cylindrical and a slide-in fit in the cylindrical enclosure.

4. The guide of claim 1 further including a flap-valve pivotally mounted within the housing and above the two pairs of rotatable rollers, so that upon removal of the pump-rod from the guide, the flap-valve will be free to move upwardly to seal off the stuffing box from the housing.

5. The guide of claim 4 wherein the flap-valve is pivotally mounted from the upper end of a sleeve, which is positioned above the two pairs of rotatable rollers.

* * * * *